US005438489A

United States Patent [19]

Judy et al.

[11] Patent Number: 5,438,489

[45] Date of Patent: Aug. 1, 1995

[54] SOLENOID DRIVER CIRCUIT AND DIAGNOSTICS

[76] Inventors: Steven W. Judy, 1119 W. Sycamore St., Chillicothe, Ill. 61523; Stephen J. Morey, 1524 W. Gilbert Ave., Peoria, Ill. 61604; April D. Ohlson, 112 Cobblestone La., East Peoria, Ill. 61611; Weldon L. Phelps, 12140 Whispering Woods, Dunlap, Ill. 61525

[21] Appl. No.: 129,505

[22] Filed: Sep. 30, 1993

[51] Int. Cl.[6] ..... H01H 47/00

[52] U.S. Cl. ..... 361/191; 361/160

[58] Field of Search ..... 361/139, 152, 154, 160, 361/191; 307/38, 40, 42

[56] References Cited

U.S. PATENT DOCUMENTS 4,173,031 10/1979 Leichle ..... 361/191
4,373,697 2/1983 Phelps ..... 251/129
4,964,014 10/1990 Boe et al. ..... 361/187
4,967,309 10/1990 Hoffman ..... 361/160

*Primary Examiner*—Jeffrey A. Gaffin

[57] ABSTRACT

An apparatus, for controllably driving a plurality of solenoids is provided. The apparatus includes a plurality of driver circuits. The plurality of driver circuits are configurable as one of proportional and binary driver circuits. A first number of the plurality of driver circuits include proportional driver circuits and a second number of the plurality of driver circuits include binary driver circuits. The apparatus controllably actuates the proportional driver circuits and the binary driver circuits. The apparatus detects failure conditions on the proportional driver circuits and the binary driver circuits and responsively produces respective failure condition signals. The apparatus is adapted to perform a proportional diagnostics routine on the proportional driver circuits and to perform a binary diagnostics routine on the binary driver circuits via the failure conditions detecting means.

6 Claims, 10 Drawing Sheets

SOLENOID DRIVER CIRCUIT AND DIAGNOSTICS

TECHNICAL FIELD

The present invention relates generally to solenoid driver circuits and, more specifically, to a solenoid driver circuit having proportional and ON/OFF driver circuits.

BACKGROUND OF THE INVENTION

Typically, manufacturers of application specific circuits will design a distinct PC board for each required circuit application. The number of specific PC boards manufactured is then determined by the number required for that specific application. The manufacturing cost of a printed circuit board (PC board) is directly related to its volume of manufacture. When the specific application requires a small number of PC boards, the cost per board can be quite high.

In the area of automatic transmission or power train controls, for example, it is often necessary for a single electronic control module to control as many as ten or more different solenoids or, depending on the specific transmission control application, as few as one or two solenoids. Moreover, in addition to the different numbers of solenoids that must be controlled in different circuit applications, there are also two principal types of solenoid control: proportional control and binary (ON/OFF) control. In any given transmission control application there can be many different combinations of the number and types of solenoid controls that must be implemented by the solenoid driver circuitry. Generally, each of those specific solenoid driver applications requires a different PC board and its limited application makes each board costly.

Additionally, it is often necessary to protect the machine and the controlled device, for example, the transmission, solenoids and controller from certain failures, for example, shorts to electrical ground, shorts to battery voltage and open circuits failures. Typically this is accomplished via failure detection circuitry or a combination of circuitry and software routines in a controller. However, the required circuitry and diagnostic scheme is different between the driver types.

The present invention is directed to overcoming one or more of the problems, as set forth above.

DISCLOSURE OF THE INVENTION

In one aspect of the present invention, an apparatus for controllably driving a plurality of solenoids is provided. The apparatus includes a plurality of driver circuits. The plurality of driver circuits are configurable as one of proportional and binary driver circuits. A first number of the plurality of driver circuits include proportional driver circuits and a second number of the plurality of driver circuits include binary driver circuits. The apparatus controllably actuates the proportional driver circuits and the binary driver circuits. The apparatus detects failure conditions on the proportional driver circuits and the binary driver circuits and responsively produces respective failure condition signals. The apparatus is adapted to perform a proportional diagnostics routine on the proportional driver circuits and to perform a binary diagnostics routine on the binary driver circuits via the failure conditions detecting means.

BEST MODE FOR CARRYING OUT THE INVENTION

Figure 1:
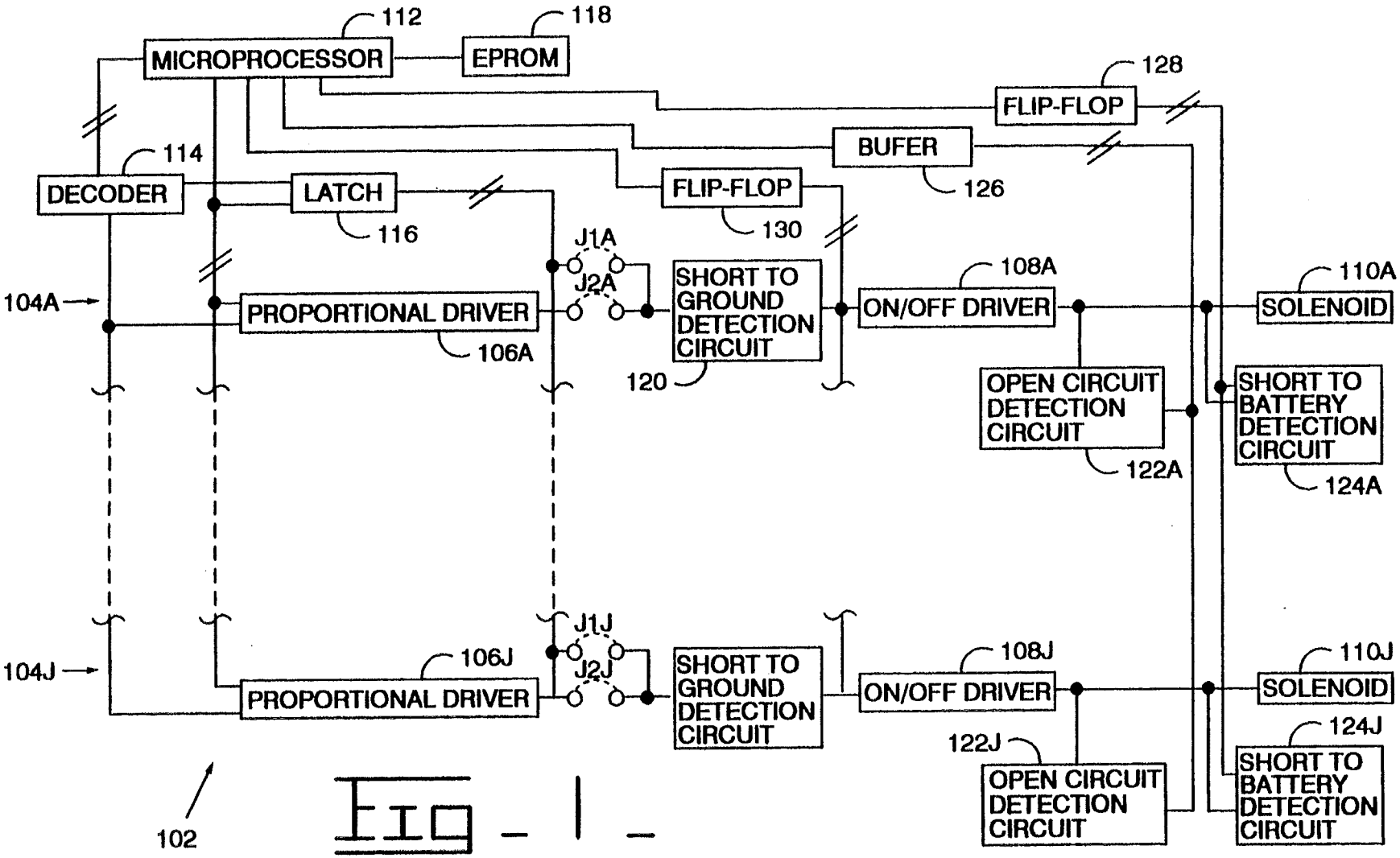
FIG. 1 is a block diagram of a control module having configurable driver circuits and failure detection circuits.

With reference to FIG. 1, the present invention provides a control module and driver circuit diagnostics. FIG. 1 is a block diagram of a generic driver circuit in which signal conditioning, filtering and other associated circuitry is not shown. Those features are well known in the art of circuit design and one skilled in the art can readily implement them in connection with the preferred embodiment.

In a preferred embodiment, the circuit board includes traces and electrical connections for ten individual solenoid driver circuits 104A–J. FIG. 1 shows the first and tenth of the ten solenoid drivers 104A–J. The second-ninth are not specifically shown, but are represented by the broken electrical connections and the ellipsis connecting the first and tenth solenoid drivers. The number of solenoid drivers is arbitrary and depends upon the maximum number of solenoids that need to be controlled in a specific application. The number of drivers can easily be increased or decreased by one skilled in the art.

The solenoid driver circuits 104 include binary (ON/OFF) type driver circuits 108A–J that drive current through a solenoid coil of a solenoid 110A–J in response to a command signal. For example, in binary driver circuit 108A when the command signal is a logic level high (typically 5 volts), the binary driver circuit 108A drives full current through the solenoid coil thereby activating the solenoid 110A. To create a proportional solenoid driver, any command signal of the particular driver may be pulse width modulated. If the command signal is so modulated, it will cause the binary driver circuit 108A to pulse current to the solenoid coil. Thus, each output of each particular binary driver 108A–J may also be pulse width modulated. Because the band width of the solenoid coils is typically very low, the pulse width modulated output signals will approximate a steady state current output that is proportional to the duration of the pulse width during each duty cycle.

Each solenoid driver circuit 104 includes a respective proportional driver circuit 106A–J. The proportional circuits 106A–J each produce a pulse width modulated command signal. The pulse width is a function of the eight data bits D0–D7 appearing at the inputs to the proportional circuitry. The number of data bits determines the resolution of the proportional driver. Thus, because there are eight data bits that are inputs to the proportional circuitry in the preferred embodiment, there are 256 different currents applied across any one of the solenoid coils.

For example, in this preferred embodiment the underlying frequency of the pulse width is 120 Hz. If a user wants the solenoid 110A to be fully activated then the command pulse would be 1/120 seconds in duration, i.e., the entire duty cycle. However, if the user desired the current through the solenoid to be half of the maximum current, then the pulse would be on for 1/240 seconds and off for 1/240 seconds. Because the bandwidth the solenoid coil is very low, the current flowing through the coil is approximately half of full current. In a similar matter, the proportional circuitry 106 can adjust the width of the command post to drive other current levels through the solenoid coil.

The user may select whether a particular driver circuit will act as a binary (ON/OFF) driver or a proportional driver by selectively placing a jumper across either J1A–J or J2A–J. If the user places a jumper across J1–A, for example, then that particular driver 104A will act as a binary driver applying either full current to the solenoid coil or no current. If the user instead places a jumper across J2, then the command input to the solenoid driver 104A will be produced by the proportional circuitry 106A. Additionally, if a driver is to be configured solely as a binary driver, the proportional driver portion of the circuit board may be left unpopulated.

A microprocessor 112 controls the commands issued to each of the solenoid drivers 104A–J through the data bus D0–D7 and several of the address lines A0–A15. The address lines A0–A15 are input to a decoder 114 which issues clock signals PWS0–PWS9 to the proportional circuitry 106A–J and clock signals PWS10,PWS11 to a first binary command latch 116. The decoder does not require all sixteen lines A0–A15 that are available on most microprocessors to issue the eleven clock signals. As can be appreciated, some addresses may be reserved to perform other functions or may be used to drive more solenoids if the circuit should contain more than ten drivers. Otherwise, if those additional functions are not necessary a microprocessor having fewer address lines may be used.

The microprocessor 112 causes a specific address to appear on the address bus, which corresponds to one of the clock signals. The decoder 114 reads the address bus and causes a specific clock signal to go high. Depending on the clock signal, one of the proportional circuits 106A–J or the upper 8 bits or lower 8 bits of the binary command latch 116 will latch the data appearing on the data bus. After latching the necessary data, the binary command latch 116 may issue a command to the appropriate binary driver circuit 108A–J and/or the proportional circuit 106A–J may issue a post width modulated command.

The microprocessor 112 control and addressing is determined by software stored in an EPROM 118 or in another suitable memory device.

In another embodiment of the present invention, the microprocessor 112 controls the configuration of the solenoid driver circuit 102. In this embodiment, microprocessor control switches (not shown) of the type known in the art are substituted for the jumper connections.

Figure 2:
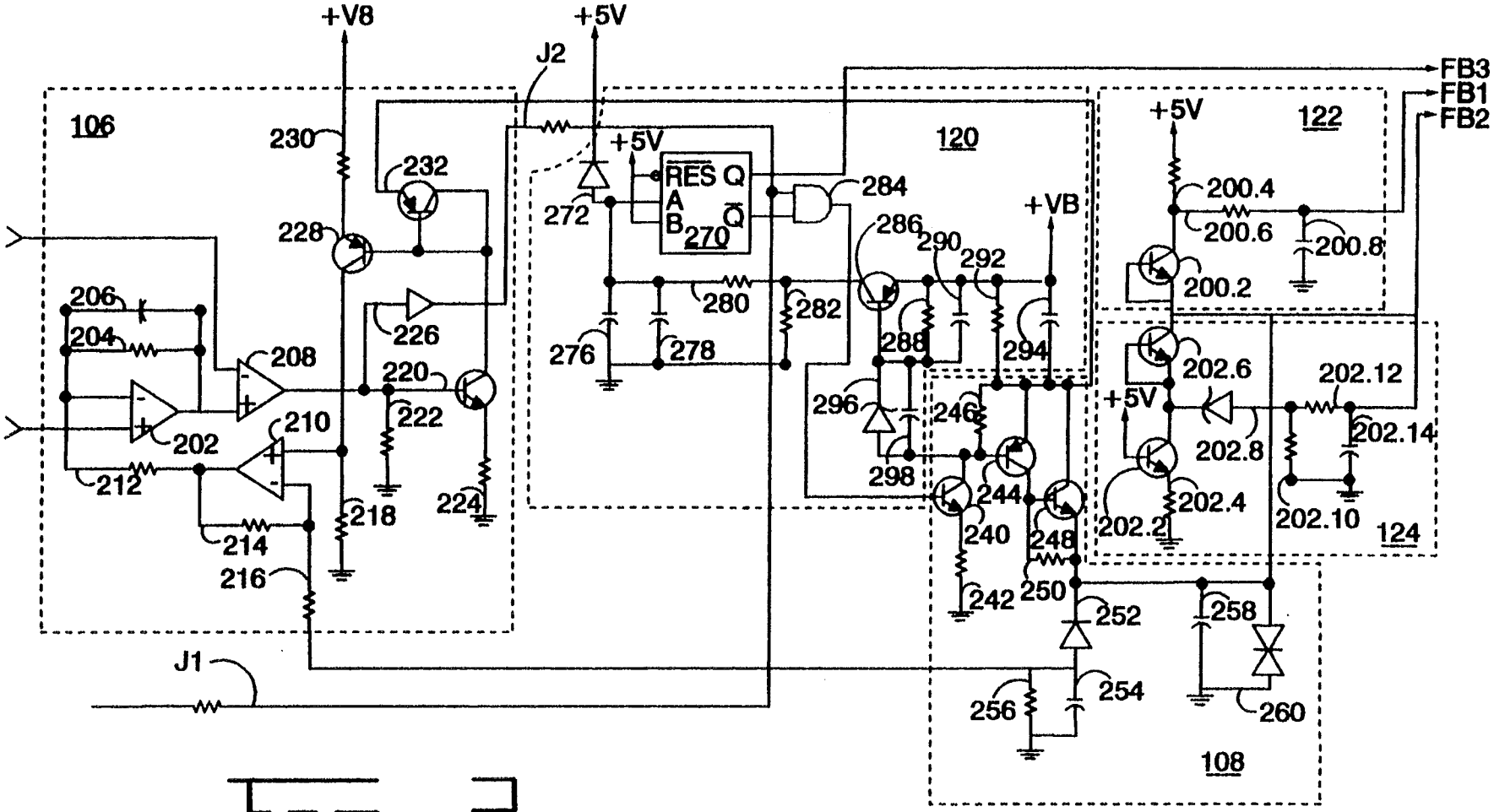
FIG. 2 is a schematic of the control module of FIG. 1.

With reference to FIG. 2, a detailed schematic of the first solenoid driver circuit 104A is illustrated. The other solenoid driver circuits 104A–J are similar. The proportional driver circuit 106A includes a first operational amplifier 202. The positive input terminal of the first operational amplifier 202 is connected to the decoder 114 via a digital to analog converter (not shown). A first resistor 204 is connected between the output terminal and the negative input terminal of the first operational amplifier 202. A first capacitor 206 is connected in parallel with the first resistor 204.

The positive input terminal of a first comparator 208 is also connected to the output of the first operational amplifier 202. The negative input terminal of the first comparator 208 is connected to a triangle waveform generator (not shown).

The output of a second operational amplifier 210 is connected to the negative input terminal of the first operational amplifier 202 via a third resistor 212. A fourth resistor 214 connects the negative output terminal and the output terminal of the second operational amplifier 210. A fifth resistor 216 connects the negative input terminal of the second operational amplifier to the ON/OFF driver circuit 108A. A sixth resistor 218 connects the positive input terminal of the second operational amplifier 210 to electrical ground.

The base of a first NPN transistor 220 is connected to the output of the first comparator 208. The base of the first NPN transistor 220 is also connected to electrical ground via a seventh resistor 222. The emitter of the first NPN transistor is connected to electrical ground via an eighth resistor 224. The base of the first NPN transistor 220 is also connected to the second jumper, J2, via a amplifier 226.

The base of a first PNP transistor 228 is connected to the collector of the first NPN transistor 220. The collector of the first PNP transistor 228 is connected to the positive input terminal of the second operational amplifier 210. The emitter of the first PNP transistor 228 is connected to the battery voltage, +VB, via a ninth resistor 230.

The base of a second PNP transistor 232 is connected to the base of the first PNP transistor 228. The base and collector of the second PNP transistor 232 are connected.

The ON/OFF driver circuit 108A includes a second NPN transistor 240. The emitter of the second NPN transistor 240 is connected to electrical ground via a tenth resistor 242. The base of a third PNP transistor 244 is connected to the collector of the second NPN transistor 240. The emitter and the base of the third PNP transistor 244 are connected via an eleventh resistor 246. The emitter of the third PNP transistor 244 is also connected to the proportional driver circuit 106A. The base of a third NPN transistor 248 is connected to the collector of the third PNP transistor 244. The collector of the third NPN transistor 248 and the emitter of the third PNP transistor 244 are connected. A twelfth resistor 250 connects the emitter and the base of the third NPN transistor 248.

The cathode of a first diode 252 is connected to the emitter of the third NPN transistor 248. The anode of the first diode 252 is connected to a second capacitor 254. The other end of the second capacitor 254 is connected to electrical ground. A thirteenth resistor 256 is connected in parallel with the second capacitor 254. A third capacitor 258 is connected between the emitter of the third NPN transistor 248 and electrical ground.

Returning to FIG. 1, a circuit 120 detects short circuits to electrical ground. With reference to FIG. 2, the short circuit detection circuit 120 includes a monostable one-shot 270. The reset input and B input of the flip flop 270 are connected to positive 5 volts. The A input is connected to 5 volts via a second diode 272. Fourth and fifth capacitors 276,278 are connected in parallel between the A input of the monostable 270 and electrical ground. A fourteenth resistor 280 is also connected to the A input of the monostable 270 at one end and to a fifteenth resistor 282 at the other end. The other end of the fifteenth resistor 282 is connected to electrical ground.

An AND gate 284 has one input connected to the Q output of the monostable 270 and a second input connected to the first and second jumpers. The output of the AND gate 284 is connected to the base of the second NPN transistor 240.

The collector of a fourth PNP transistor 286 is connected to the junction between the fourteenth and fifteenth resistors 280,282. A sixteenth resistor 288 is connected between the emitter and the base of the fourth PNP transistor 286. A sixth capacitor 290 is connected in parallel with the sixteenth resistor 288. A seventeenth resistor 292 and a seventh capacitor 294 are connected in parallel between the emitter of the fourth PNP transistor 286 and the ON/OFF driver circuit 108A. The emitter of the fourth PNP transistor 286 is also connected to battery voltage, +VB. A first Zener diode 296 has a cathode connected to the base of the fourth PNP transistor 286 and an anode connected to the base of the third PNP transistor 244. An eighth capacitor 298 is connected in parallel with the first Zener diode 296.

Returning to FIG. 1, a circuit 122 detects open circuit failures. With reference to FIG. 2, the open circuit detection circuit 122 includes a fourth NPN transistor 200.2. The collector of the fourth NPN transistor 200.2 is connected to an eighteenth resistor 200.4. The eighteenth resistor 200.4 is connected to positive 5 volts. A nineteenth resistor 200.6 is connected at one end to the collector of the fourth NPN transistor 200.4 and to a ninth capacitor 200.8 at the other end. The base and emitter of the fourth NPN transistor 200.4 are connected.

Returning to FIG. 1, a circuit 124 detects short circuits to battery. With reference to FIG. 2, the short to battery detection circuit 124, includes a fifth NPN transistor 202.2. The base of the fifth NPN transistor 202.2 is connected to positive 5 volts. The emitter of the fifth NPN transistor 200.2 is connected to electrical ground via a twentieth resistor 202.4. The base and the emitter of a sixth NPN transistor 202.6 are connected to the collector of the fifth NPN transistor 202.2. The collector of the sixth NPN transistor 202.6 is connected to the base and the emitter of the fourth NPN transistor 200.2. A second Zener diode 202.8 has a cathode connected to the collector of the fifth NPN transistor 202.2. The anode of the second Zener diode 202.8 is connected to electrical ground via twenty-second resistor 202.10. A twenty-third resistor 202.12 is connected to the twenty-first resistor 202.10 and electrical ground via a tenth capacitor 202.14.

The open circuit detection circuit 122, the short circuit to battery detection circuit 124, and the short circuit to electrical ground detection circuit 120 produce first, second and third feedback signals (FB1,FB2,FB3). The feedback signals are relayed to the microprocessor 112 via a second flip-flop 126, a third flip-flop 128 and a buffer 130 respectively. Preferably, the second and third flip-flops 126,130 are active low S-R type flip-flops. The first feedback signal, FB1, is a function of the voltage across the ninth capacitor 200.8. The second feedback signal, FB2, is a function of the voltage across the tenth capacitor 202.14. The third feedback signal, FB3, is the output, Q, of the monostable 270.

With reference to FIGS. 3–8, the microprocessor 112 is programmed to perform diagnostic routines on the driver circuits 104A–J according to a first embodiment of the present invention. For purposes of illustration, the diagnostic routines are discussed with reference to the first solenoid driver circuit 104A. Operation of the diagnostics for the other circuits 104B–J is similar.

The diagnostic routines for each driver circuit 104A–J is dependent upon whether the circuit is configured as a proportional driver or as an ON/OFF driver. The diagnostic failure conditions are shown in Table 1. In Table 1, A represents the analog feedback signal (FB1,FB2,FB3) and D represents the digital signal on the data bus.

TABLE 1

| | | DIAGNOSTIC CONDITIONS | | | | | |
|---|---|---|---|---|---|---|---|
| | | ON/OFF DRIVER ON | | PROPORTIONAL DRIVER ON | | ON/OFF OR PROPORTIONAL DRIVER OFF | |
| | | A | D | A | D | A | D |
| NORMAL OPERATION | FB1 | 1 | 0 | U | 1 | 0 | 1 |
| | FB2 | 1 | 0 | U | 1 | 0 | 1 |
| | FB3 | 0 | 0 | 0 | 0 | 0 | 0 |
| SHORT TO GND | FB1 | 0 | 1 | 0 | 1 | 0 | 1 |
| | FB2 | 0 | 1 | 0 | 1 | 0 | 1 |
| | FB3 | 1 | 1 | 1 | 0 | 0 | 0 |
| SHORT TO BATTERY | FB1 | 1 | 0 | 1 | 0 | 1 | 0 |
| | FB2 | 1 | 0 | 1 | 0 | 0 | 0 |
| | FB3 | 0 | 0 | 0 | 0 | 0 | 0 |
| OPEN CIRCUIT | FB1 | 1 | 0 | U | 0 | 1 | 0 |
| | FB2 | 1 | 0 | U | U | 0 | 1 |
| | FB3 | 0 | 0 | 0 | 0 | 0 | 0 |

During normal operations, the second and third flip-flops 126,128 and the buffer 130 are read and diagnosed once per software control loop (15 milliseconds). In the preferred embodiment, the second and third flip-flops 126,128 are active low S-R flips-flops. Below, the output of the flip-flops will be discussed in terms of logic-0 and logic-1, which corresponds to a positive voltage level and a zero (0) voltage level, respectively. After the second and third flip-flops 126,128 are read, they are reset so that the outputs (Q) are equal to zero. The following discussion will be in terms of the data on the data bus (D).

Figure 3:
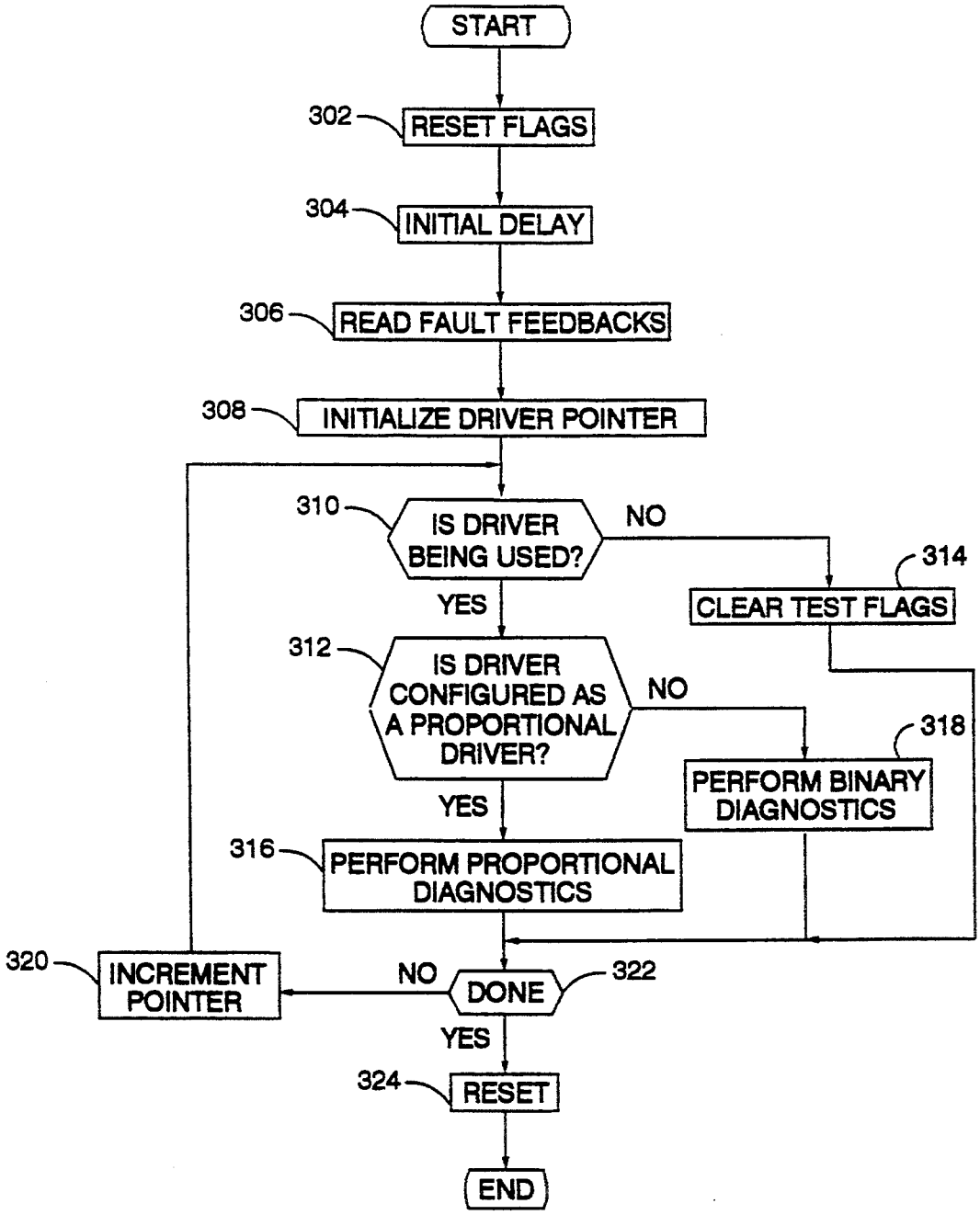
FIG. 3 is a flow diagram illustrating operation of a diagnostics routine for performing a proportional diagnostics routine and a binary diagnostics routine, according to an embodiment of the present invention.

With specific reference to FIG. 3, the general diagnostic routine is illustrated according to the first embodiment. In a control block 302, the failure flags are reset. The failure flags are indicative of undebounced failures. The flags are cleared each control loop. In a control block 304 an initial delay is implemented. The initial delay is only performed after power-up and renders the diagnostics inoperative for at least one control loop so that erroneous failures are not detected.

In a control block 306, the feedback signals, FB1,FB2,FB3, are read from the second and third flip flops 126,128 and buffer 130, respectively. In a control block 308, a driver pointer is initialized to the first driver.

In a decision block 310, if the current driver (indicated by the driver pointer) is being used in the circuit, then control proceeds to a decision block 312. If the driver is not being used, then control proceeds to a control block 314. The status of each driver circuit 104A–J, that is whether or not it is being used, is stored in a computer look-up table.

In control block 314 the test flags are cleared. This is a redundant step which ensures that all test flags are cleared correctly.

In decision block 312, if the driver is configured as a proportional driver, then control goes to a control block 316. If the driver is not configured as a proportional driver, then control goes to a control block 318.

In control block 316, the proportional diagnostics are performed (described below). In control block 318 the binary diagnostics are performed (described below).

In decision block 322, if all driver circuits have been tested, then control goes to a control block 324. If all the drivers have not been tested, then control goes to an control block 320. In control block 320, the driver pointer is incremented. In control block 324, the flip flops are reset.

In the diagnostic routines, failure detections must be distinguished from spurious failure detections. In other words, in order to determine whether or not a true failure is detected, the failure must be detected for a predetermined number of times in a row. This is known as debouncing.

Figure 4:
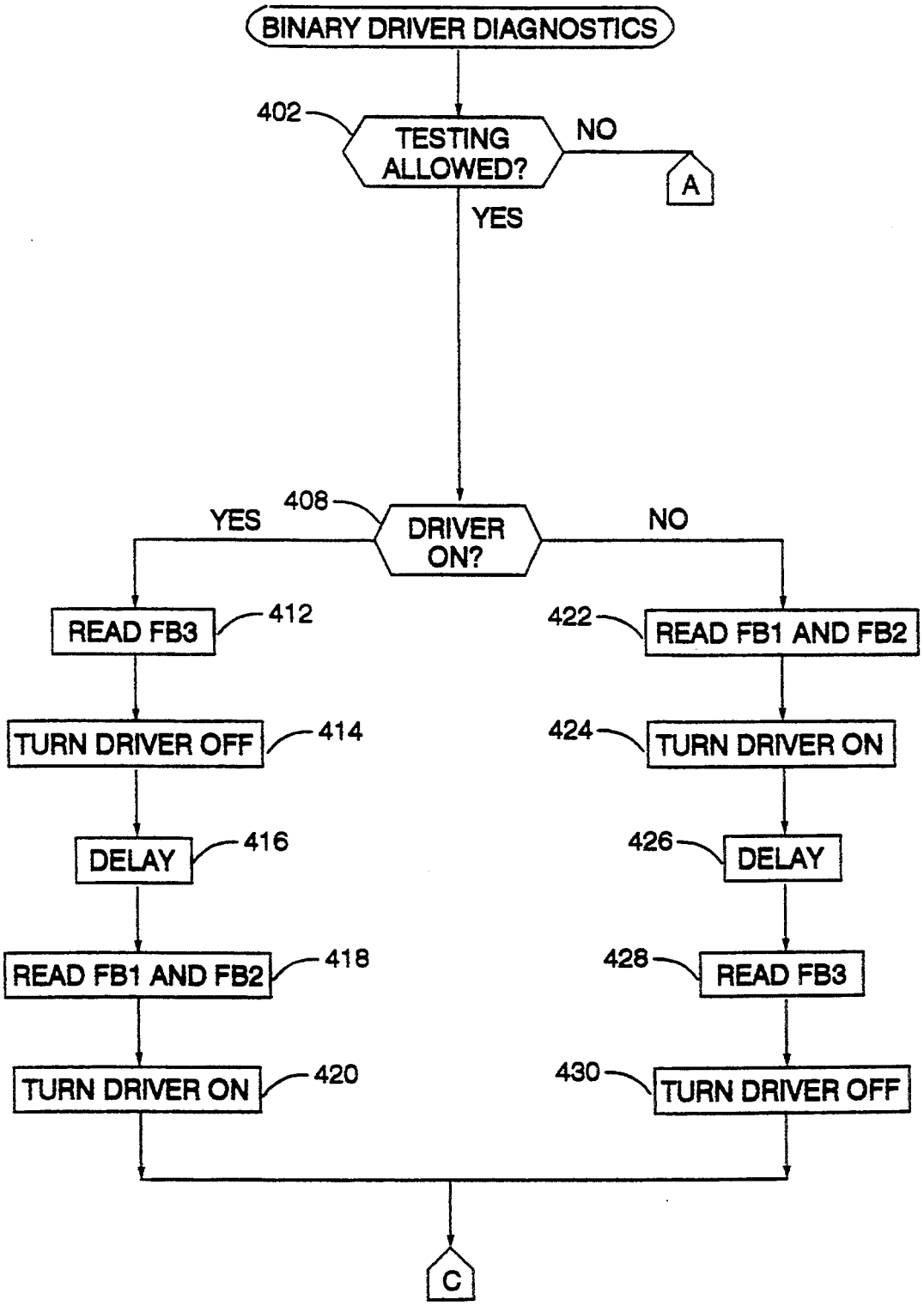
FIG. 4 is a first portion of a flow diagram illustrating operation of the binary diagnostics routine of FIG. 3.
Figure 5:
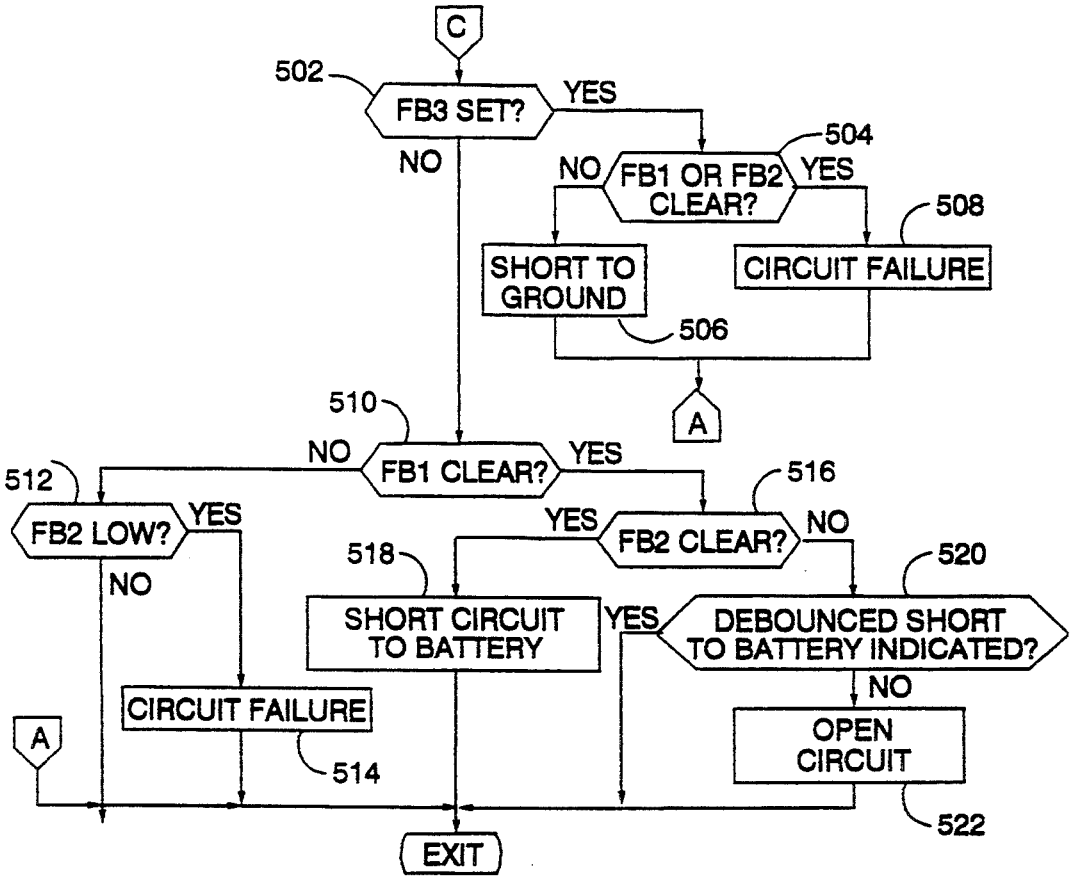
FIG. 5 is a second portion of a flow diagram illustrating operation of the binary diagnostics routine of FIG. 3.

With reference to FIGS. 4–5, the diagnostics for the ON/OFF drivers is illustrated. In the preferred embodiment, FB1 and FB2 are read with the driver OFF and FB3 is read with the driver ON.

In a decision block 402, if testing is allowed on the ON/OFF driver then control goes to a decision block 408. Testing of the ON/OFF driver circuit affects the current. Therefore, to minimize the effect on the output current testing of the ON/OFF drivers is not allowed every control loop. In a decision block 408, if the driver circuit is currently ON, then control proceeds to an control block 412.

In control block 412, the third feedback signal, FB3, is read. In a control block 414, the driver circuit is turned off. In a control block 416, a predetermined delay is implemented. In a control block 418, the first and second feedback signals, FB1,FB2, are read. In a control block 420, the driver circuit is turned back on.

If in decision block 408, the driver circuit is not ON, then control proceeds to a control block 22.

In control block 422, the first and second feedback signals, FB1,FB2, are read. In a control block 424, the driver circuit is turned on. In a control block 426, a predetermined delay is implemented. In a control block 428, the third feedback signal, FB3, is read. In a control block 30, the driver circuit is turned back off.

In a decision block 502, if the third feedback signal is set then control proceeds to an decision block 504. If both the first and second feedback signals are set, then a short to ground failure is detected and control proceeds to a control block 506. In control block 506, the driver is deemed to be shorted to ground and a corresponding failure flag is set.

If either of the first or second feedback signals, FB1,FB2, are clear, then the diagnostics have detected an erroneous pattern and control proceeds to a control block 508. In control block 508, the circuit is deemed to be failed and a corresponding failure flag is set. If, in decision block 502, the third feedback signal is not set then control proceeds to a decision block 510. In decision block 510, if the first feedback signal is not clear, then control proceeds to a decision block 512. If the first feedback signal is clear, then control proceeds to a decision block 516.

In decision block 512, if the second feedback signal is clear or low, then the diagnostics have detected an erroneous pattern and control proceeds to a control block 514. In control block 514, the circuit is deemed to be failed and the corresponding failure flag is set.

In decision block 516, if the second feedback signal is clear then a short circuit to battery exists and control proceeds to a control block 518. In control block 518, the circuit is deemed to be short circuited to battery and a corresponding failure flag is set.

In decision block 516, if the second feedback signal is not clear, then control proceeds to an decision block 520. In decision block 520, if a debounced short circuit to battery failure is not indicated then control proceeds to a control block 522. In control block 522 the circuit is deemed to be open circuited and a corresponding failure flag is set.

Figure 6:
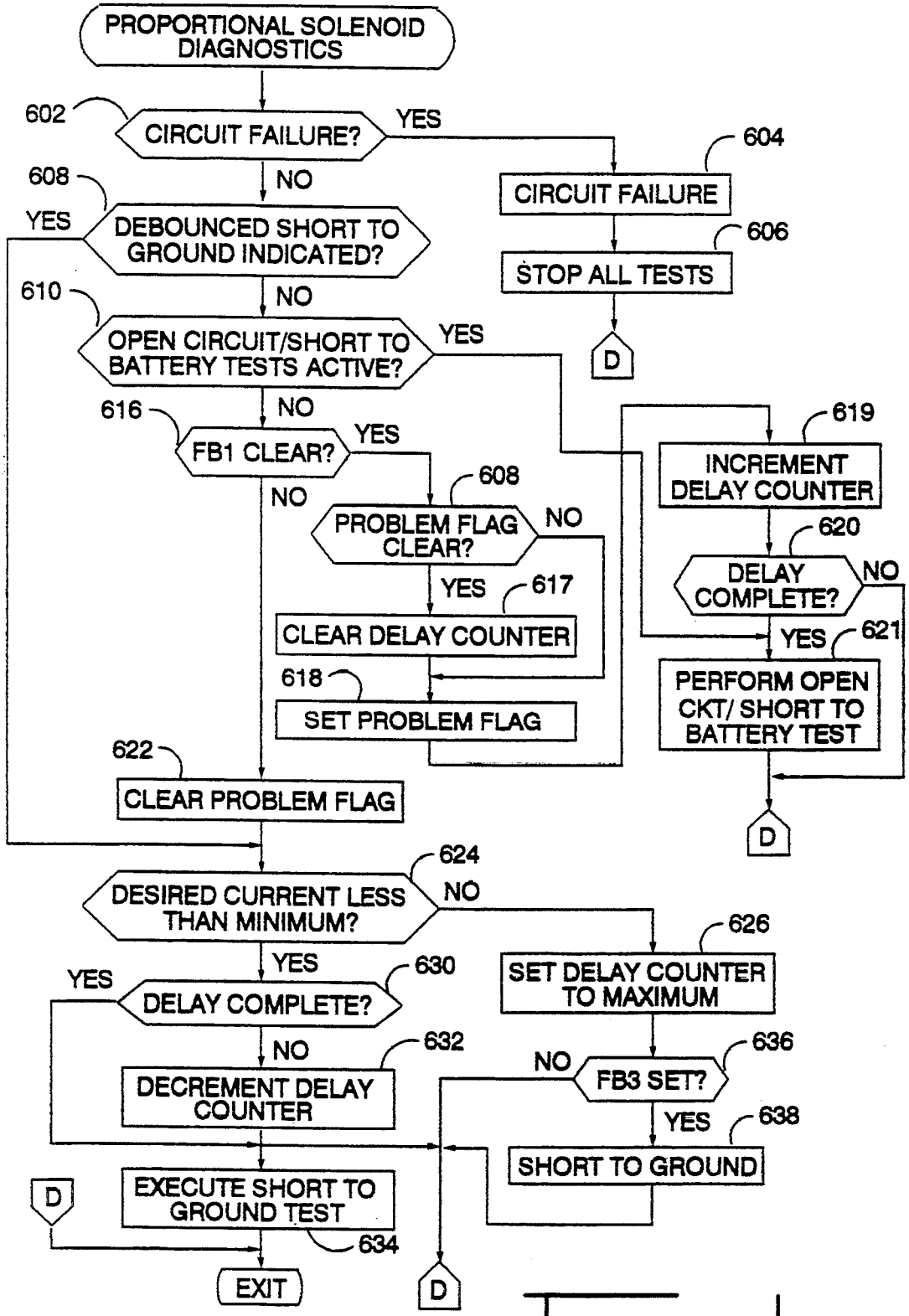
FIG. 6 is a first portion of a flow diagram illustrating operation of the proportional diagnostics routine of FIG. 3.

With reference to FIG. 6, the proportional diagnostics are illustrated. The routine illustrated is executed once every control loop. However, the actual tests are run over several control loops.

In a decision block 602, if the circuit is determined to be failed then control proceeds to a control block 604. The circuit is deemed to be failed if the feedback pattern does not correspond to a permissible pattern. A permissible pattern includes the normal operating pattern and the failure patterns. That is, if {FB1, FB2, FB3} does not equal {1,1,0}, {1,1,1}, {0,0,0}, or {0,1,0} then a problem exists with the diagnostic circuit. In control block 604, the monitoring or diagnostic circuit is deemed to be failed and the corresponding flag is set. In a control block 606, the tests are stopped and the routine is exited.

If the circuit has not failed then control proceeds to a decision block 608. If a debounced short to ground is not indicated then control proceeds to a decision block 610. This disables the open circuit and short to battery tests while a short to ground failure exists. In the preferred embodiment, the debounced short to ground indication remains for a predetermined time after the short to ground is removed in order to eliminate erroneous failure readings.

In decision block 610, if the open circuit and short to battery tests are active (currently being run) then control proceeds to a control block 621. In control block 621, the open circuit and short to battery routines are executed.

If, in decision block 610, the open circuit and short to battery tests are not active control proceeds to a decision block 616. If FB1 is clear then either an open circuit or an short to battery failure or a saturated driver exists.

If, in decision block 616, FB1 is clear then control proceeds to an decision block 608. In decision block 608, if a problem flag is not set then control proceeds to a control block 618.

If, in decision block 608, the problem flag is not clear then control proceeds to control block 618.

In control block 618, the problem flag is set. In control block 610, the delay counter is incremented. In decision block 620, if the delay is complete, then control proceeds to control block 621 in which the open circuit and short to battery tests are performed. If the delay is not complete then the routine is exited. Control and decision blocks 616–620 ensure that the before the open circuit and short to battery tests are executed, the problem flag is set.

In order to run the short to ground tests the driver must be ON. In a decision block 624, if the desired current is less than a minimum current (is the driver OFF?) then control proceeds to a decision block 630. A delay is implemented in decision block 630 and a control block 632.

In decision block 630, if the delay is not complete then control proceeds to control block 632. A delay counter is decremented in control block 632 and control loop is exited.

If, in decision block 624, the desired current is not less than the minimum the control proceeds to a control block 626. In control block 626, the delay counter is set to the maximum.

In a decision block 636, if FB3 is set then a short circuit to ground exists and control proceeds to a control block 638. In control block 638, the current driver circuit is deemed to be short circuited to ground and a corresponding flag is set. The control loop is then exited.

If, in decision block 630, the delay is complete then the short circuit to ground test is executed in a control block 634.

Figure 7:
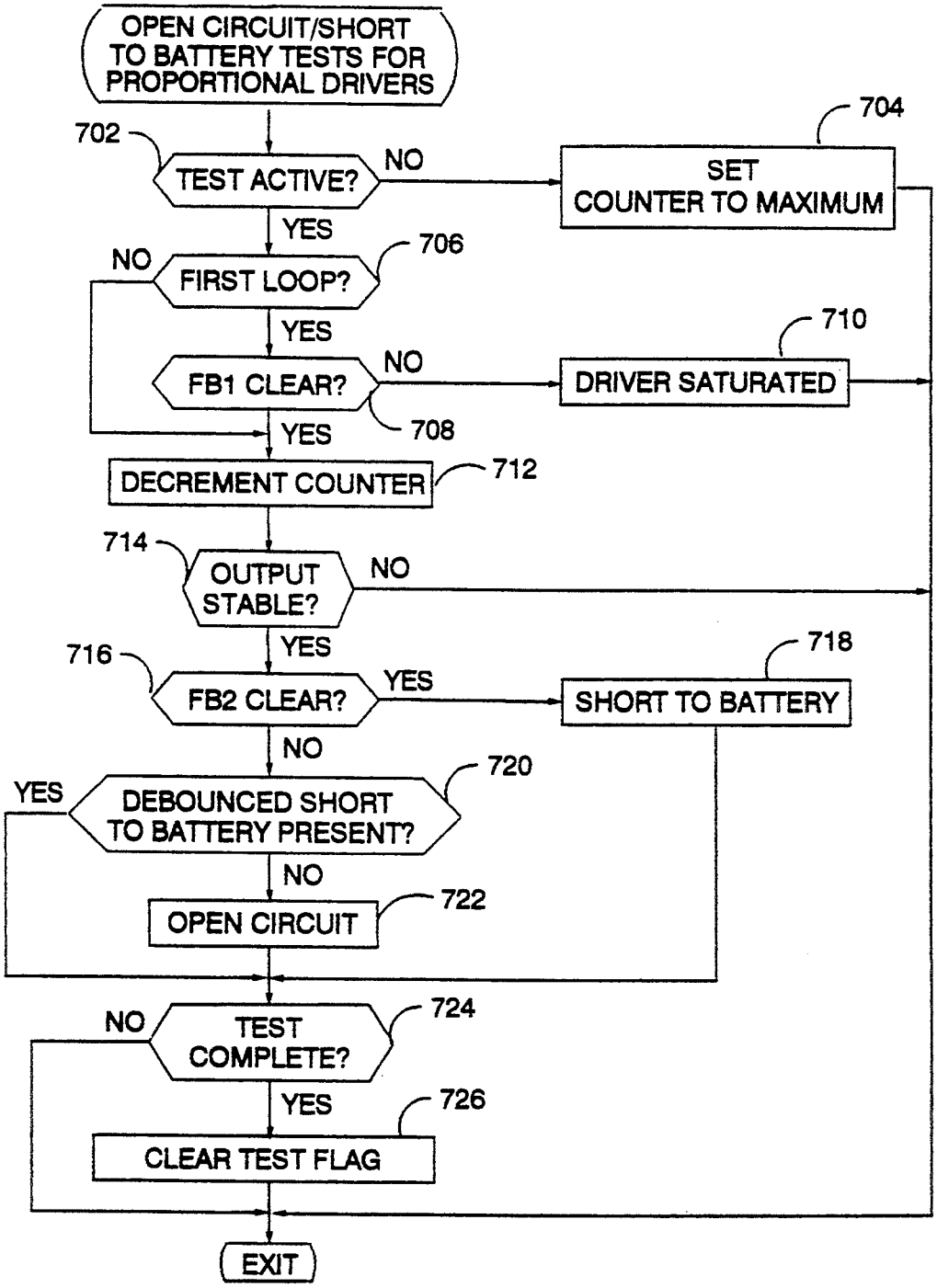
FIG. 7 is a second portion of a flow diagram illustrating operation of the proportional diagnostics routine of FIG. 3.

FIG. 7 illustrates a flow diagram of the open circuit and short circuit tests for the proportional drivers according to an embodiment of the present invention. While the open circuit and short circuit tests are active, a flag is set. In a decision block 702, if the test is currently active then control proceeds to a decision block 706. If the test is not currently active then control proceeds to a control block 704.

In control block 704,1a counter is set to a maximum value, the driver is turned ON (if not already ON) and the test active flag is set. The routine is then exited. The counter sets the length of the test.

In decision block 706, if this is the first software loop (with the test being active) then control proceeds to a decision block 708. If this is not the first loop then control proceeds to a control block 712.

In decision block 708, if FB1 is clear then control proceeds to control block 712. If FB1 is not clear then control proceeds to a control block 710. In control block 710, the driver is deemed to be saturated, a corresponding failure flag is set and the routine is exited. Driver saturation may occur when operating in high temperatures or when the driver is being abused.

In control block 712, the duration counter is decremented. In a decision block 714, if the output is stable then control proceeds to a decision block 716. The output is assumed to be stable after a predetermined time after the driver is first turned ON. If the output is not stable then the routine is exited.

In decision block 716, if FB2 is clear then control proceeds to a control block 718. If FB2 is not clear then the driver is not short circuited to battery and control proceeds to a decision block 720.

In control block 718, the driver circuit is deemed to be shorted to battery and a the corresponding flag is set. Control then proceeds to a decision block 724.

In decision block 720, if a debounced short to battery failure is present, then control proceeds to decision block 724. If a debounced short to battery failure is not present then control proceeds to a control block 722. In control block 722, the driver is deemed to be open circuited.

In decision block 724, if the test is complete (as indicated by the counter) then control proceeds to a control block 726. In control block 726, the active test flag is cleared, indicating that the open circuit and short to battery tests are not active and the driver is restored to its original state.

Figure 8:
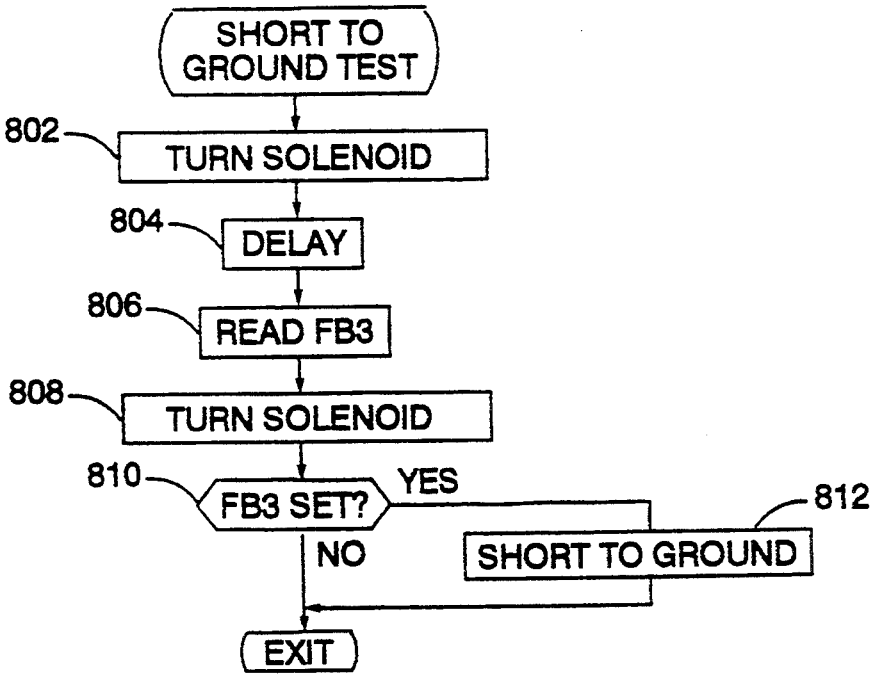
FIG. 8 is a flow diagram illustrating operation of the short to ground test, according to an embodiment of the present invention.

With reference to FIG. 8, the short to ground test is illustrated. In a control block 802, the solenoid is turned on. If a control block 804, a delay is implemented. In a control block 806, FB3 is read. In a decision block 810, if FB3 is set then the driver is short circuited to ground and control proceeds to a control block 812. In control block 812, the driver is deemed to be shorted to electrical ground and the corresponding flag is set.

Figure 9:
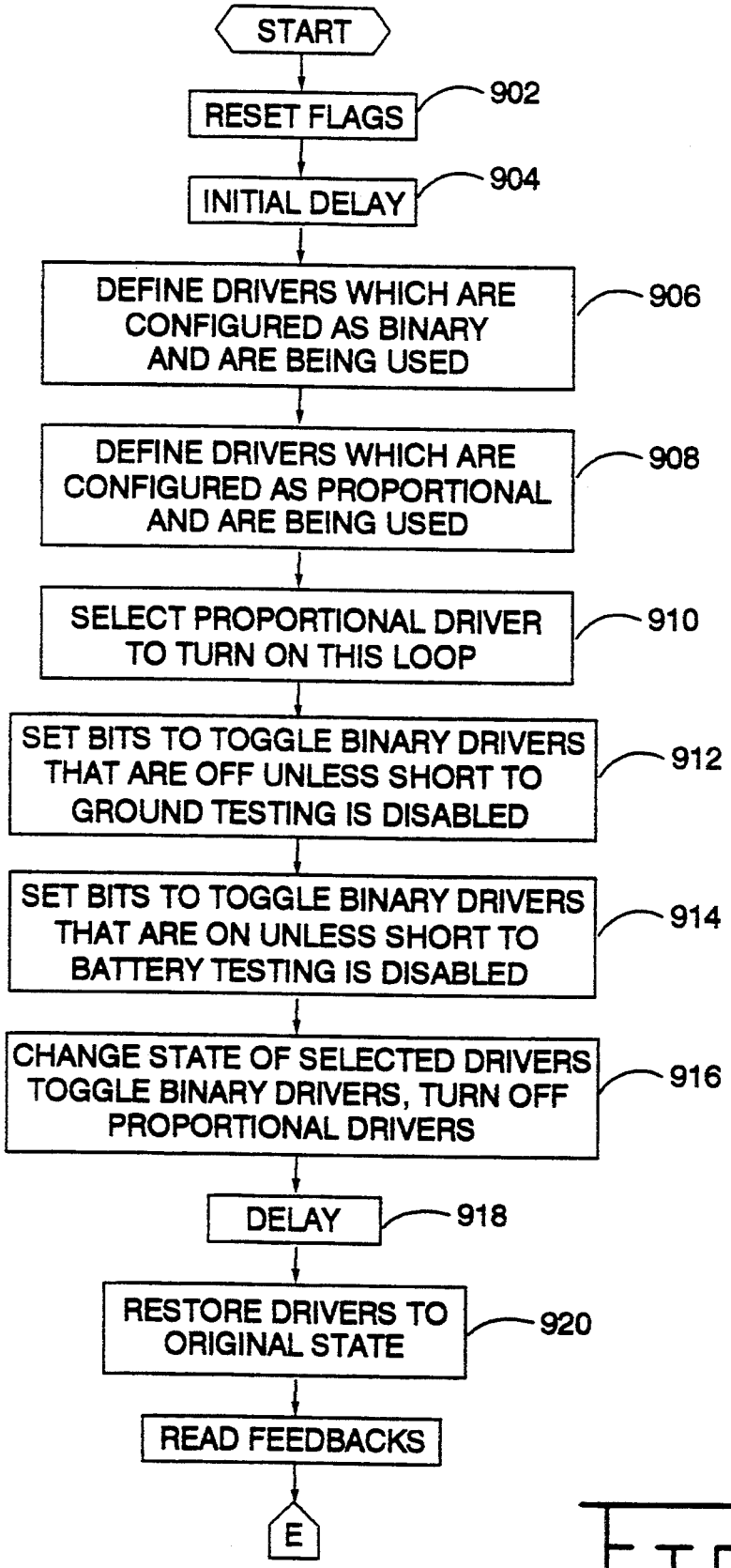
FIGS. 9 and 10 illustrate flow diagrams incorporated in a second embodiment of the invention.
Figure 10:
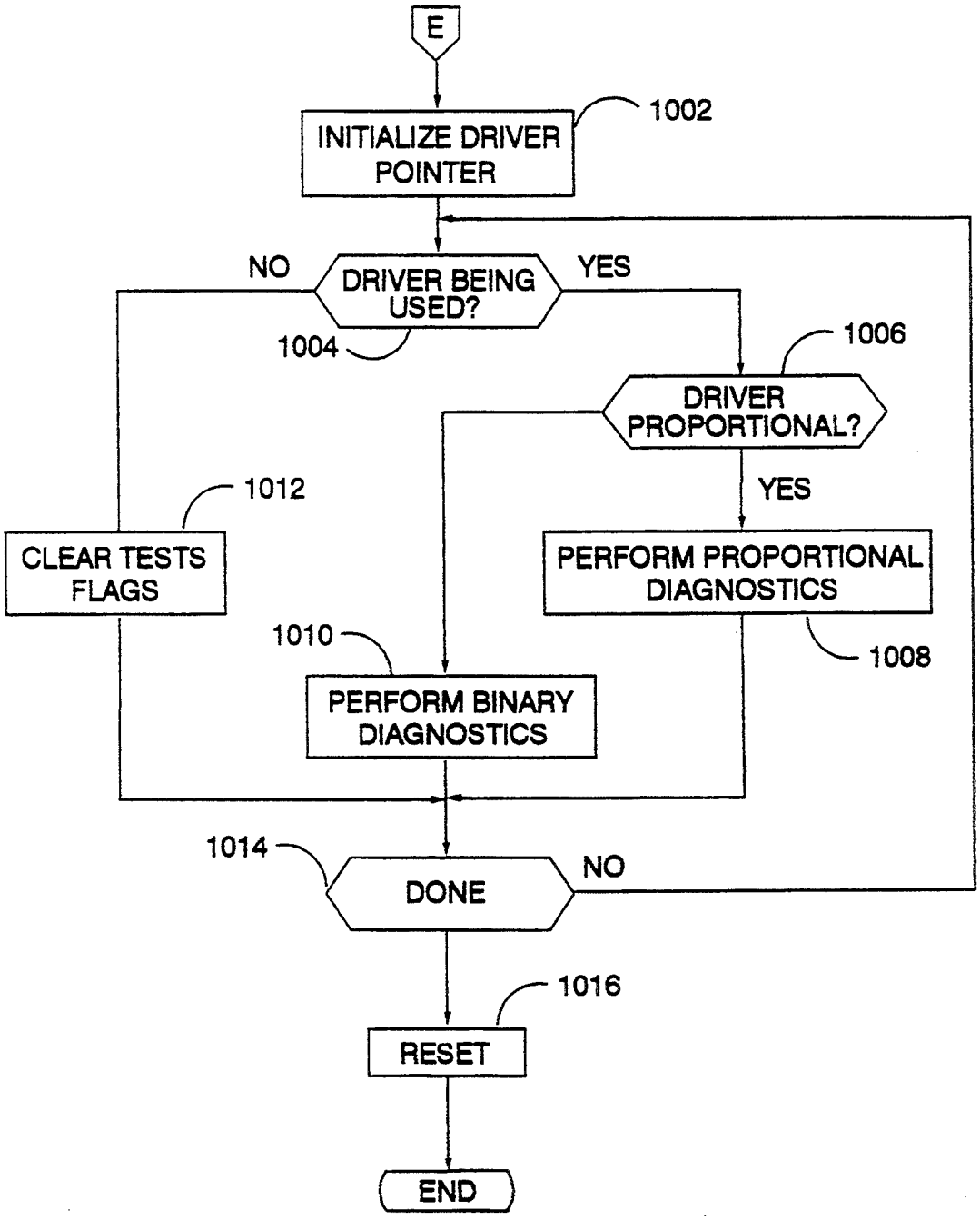

With reference to FIGS. 9 and 10, a second embodiment of the present invention is illustrated. In the first embodiment, each driver is tested individually. During the individual test, the respective driver may have to be toggled on or off. In the second embodiment, the drivers which have to be toggled are identified and their state is toggled before the individual tests.

In a control block 902, the failure flags are reset. In a control block the initial delay is implemented. In a control block 906, the drivers which are configured as binary drivers and which are being used are identified. In a control block 908, the drivers which are configured as proportional drivers and which are being used are identified.

In a control block 910, a proportional driver to be tested is selected. As above, testing of the proportional drivers affects the output current. To minimize this effect, the drivers are not tested every loop.

In a control block 912, unless short to ground testing is disabled, the binary drivers that are off are identified for toggling.

In a control block 914, unless short to battery testing is disabled, the binary drivers that are on are identified for toggling.

In a control block 916, the state of the drivers are toggled. The proportional drivers are turned on and the state of the binary drivers are toggled.

In a control block 918, a delay is implemented.

In a control block 920, the drivers are restored to their original state.

In a control block 922, the feedbacks are read.

In a control block 1002, a driver pointer is initialized.

In a decision block 1004, if the driver is being used, then control proceeds to a decision block 1006. In decision block 1006, if the driver is configured as a proportional driver then control proceeds to a control block 1008. In control block 1008, the proportional diagnostics are performed.

If the driver is not configured as a proportional driver, then the binary diagnostics are performed in a control block 1010.

If the driver is not being used, then the tests flags are cleared in a control block 1012.

In decision block 1014, if all the drivers have not been tested then the pointer is updated and control returns to decision block 1004. If all the drivers have been tested, then the circuit is reset in control block 1016.

The binary and proportional diagnostic routines are similar as those discussed in the first embodiment, except that the drivers do not have to be toggled in the binary and proportional diagnostic routines.

Industrial Applicability

With reference to the drawings and in operation, the present invention provide a generic solenoid driver PC board having many uses. In one embodiment, the present invention includes a generic solenoid board having ten solenoid driver circuits. The ten driver circuits are configurable as binary or proportional type driver circuits. The type is configured by the user through a pair or jumpers or through a controller (see above).

For example, if a specific application requires 5 binary solenoid drivers and three proportion drivers, then the first five driver circuits 104A–E may be configured as binary drivers, the next three drivers (103F–H) are configured as proportional and the last two are not used. In order to configure the first five drivers as binary, the binary driver circuit portion of the PC board must be populated and the corresponding first jumpers (J1A–E) must also be present. For the drivers configured as proportional drivers (104F–H), both the binary and proportional portions of the PC board must be populated. Additionally, the second jumpers (J2F–H) are present instead of the first jumpers (J1). Neither portions of the last two drivers are populated.

In other example, if the application is designed to be flexible, that is, does not have a set number of proportional or binary drivers or if then all of the binary and proportional circuits portions may be populate. Specific drivers may be configured as either binary or proportional by switching jumpers or through microprocessor controlled switches.

The microprocessor is programmed to controllably actuate the drivers circuits in a manner corresponding to what type of driver each is configured as. Additionally, the microprocessor is adapted to perform diagnostics to detect short circuits and open circuits. Moreover, the microprocessor is adapted to perform a proportional diagnostic routine on the driver circuits configured as proportional drivers and a binary diagnostics scheme on the driver circuits configured as binary drivers.

Other aspects, objects, and features of the present invention can be obtained from a study of the drawings, the disclosure, and the appended claims.

We claim:

1. An apparatus, for controllably driving a plurality of solenoids, comprising:

a plurality of driver circuits, said plurality of driver circuits configurable as one of proportional and binary driver circuits, wherein a first number of said plurality of driver circuits include proportional driver circuits and a second number of said plurality of driver circuits include binary driver circuits;

controlling means, connected to said plurality of driver circuits, for controllably actuating said proportional driver circuits and said binary driver circuits;

means for detecting failure conditions on said proportional driver circuits and said binary driver circuits and responsively producing respective failure condition signals; and wherein, said controlling means including means for receiving said failure condition signals and being adapted to perform a proportional diagnostic routine on said proportional driver circuits and to perform a binary diagnostics routine on said binary driver circuits via said failure conditions detecting means.

2. An apparatus, as set forth in claim 1, wherein said failure conditions detecting means includes means for detecting short circuit failures on said proportional driver circuits and said binary driver circuits and responsively producing a short circuit signal.

3. An apparatus, as set forth in claim 1, wherein said failure conditions detecting means includes means for detecting open circuit failures on said proportional driver circuits and said binary driver circuits and responsively producing an open circuit signal.

4. An apparatus, as set forth in claim 1, wherein said failure conditions detecting means includes means for detecting short to battery failures on said proportional driver circuits and said binary driver circuits and responsively producing a short to battery signal.

5. An apparatus, as set forth in claim 1, wherein said failure conditions signals include a short circuit signal, an open circuit signal, and short to battery signal.

6. An apparatus, as set forth in claim 1, wherein said failure conditions detecting means includes:

means for detecting short circuit failures on said proportional driver circuits and said binary driver circuits and responsively producing a short circuit signal;

means for detecting open circuit failures on said proportional driver circuits and said binary driver circuits and responsively producing a open circuit signal; and means for detecting short to battery failures on said proportional driver circuits and said binary driver circuits and responsively producing a short to battery signal.

* * * * *

UNITED STATES PATENT AND TRADEMARK OFFICE

CERTIFICATE OF CORRECTION

PATENT NO. : 5,438,489

DATED : August 1, 1995

INVENTOR(S) : Judy et al

It is certified that error appears in the above-identified patent and that said Letters Patent is hereby corrected as shown below:

On the Title page of the patent, please add --Assignee: Caterpillar Inc., Peoria, Ill--.

Signed and Sealed this

Fourteenth Day of May, 1996

*Attest:*

Bruce Lehman

BRUCE LEHMAN

*Attesting Officer*

*Commissioner of Patents and Trademarks*